United States Patent [19]

Noguchi

[11] 4,439,275

[45] Mar. 27, 1984

[54] COKE CALCINING APPARATUS

[75] Inventor: Kosaku Noguchi, Tokyo, Japan

[73] Assignee: Koa Oil Company, Limited, Chiyoda, Japan

[21] Appl. No.: 448,502

[22] Filed: Dec. 9, 1982

[30] Foreign Application Priority Data

Apr. 26, 1982 [JP] Japan ..... 57-69762

[51] Int. Cl.³ ..... C10B 1/10; C10B 39/00; C10B 39/12

[52] U.S. Cl. ..... 202/100; 202/216; 202/227; 202/230; 432/83; 432/106

[58] Field of Search ..... 202/100, 131, 216, 218, 202/227, 230; 201/17, 32, 39; 432/81, 83, 106, 110, 111

[56] References Cited

U.S. PATENT DOCUMENTS

| | | | |
|---|---|---|---|
| 2,785,115 | 3/1957 | Borch | 201/39 |
| 3,372,915 | 3/1968 | Jensen | 432/83 |
| 3,502,139 | 3/1970 | Andersen | 432/83 |
| 4,022,569 | 5/1977 | Farago et al. | 201/32 |
| 4,100,265 | 7/1978 | Yoshimura et al. | 201/17 |
| 4,101,268 | 7/1978 | Groiss | 432/106 |
| 4,169,767 | 10/1979 | Noguchi et al. | 202/216 |

*Primary Examiner*—Bradley Garris

*Attorney, Agent, or Firm*—Wenderoth, Lind & Ponack

[57] ABSTRACT

A coke calcining apparatus comprises a rotary kiln (1), an intermediate cooler (3) installed outside of but rotating unitarily with the kiln at an intermediate part thereof and having inlets (32) and outlets (33) respectively communicating with the upstream and downstream interiors (A,B) of the kiln, and an annular weir (7) fixed to and around the inner wall surface of the kiln at a part thereof between the inlets and outlets of the cooler and functioning to cause the entire quantity of coke (6) which has been subjected to a first-stage calcination at 600° to 1,000° C. in the upstream interior (A) to flow through the cooler (3). The coke thus cooled to 200° C. or lower is subjected to a second-stage calcination at 1,200° to 1,400° C. in the downstream interior (B) for 10 to 30 minutes.

8 Claims, 6 Drawing Figures

COKE CALCINING APPARATUS

BACKGROUND OF THE INVENTION

This invention relates to a coke calcining apparatus suitable for producing high-grade coke, especially such high grade coke as is suitable for use in fabricating graphite electrodes, by two-stage calcination with intermediate cooling.

Preparation of green coke from heavy oils of petroleum origin such as residue oils of catalytic cracking and thermal cracking, straight run residue oils and tar of thermal cracking, coal tar pitch or mixtures thereof by a delayed coking process is known in the art. The green coke produced by this process still contains a significant quantity of moisture and volatile matter. Accordingly, there is also known a process for calcining the produced green coke in order to remove the moisture and volatile matter from the green coke and to densify the same, thereby producing a carbon material having a high density and a low coefficient of thermal expansion which is suitable for use as an electrode material for steel-making, aluminum smelting or the like or a carbon material for other shaped articles.

Calcining of such green coke is carried out in heating furnaces such as a rotary kiln, a rotary hearth, and a shaft kiln in a single stage, or in two stages by further providing a preheating furnace.

However, as a result of my studies, I have found that calcined coke obtained by this process does not necessarily have fully satisfactory properties as coke for artificial graphite electrodes which is required to be of particularly high quality. That is, there remains much room for improvement with respect to high density and low coefficient of thermal expansion which are the most important properties required of coke for artificial graphite electrodes.

On the other hand, our research staff has found that cooling in an intermediate stage in the calcination of coke is highly effective in reducing the coefficient of thermal expansion of the calcined coke and increasing the density, particularly the true density thereof, and has developed a process for producing high-grade coke. This process for calcining coke comprises first calcining green coke obtained by a delayed coking process at a temperature lower than an ordinary calcining temperature, cooling once the calcined coke, and thereafter calcining the coke again at a temperature in the ordinary calcining temperature range (as disclosed in U.S. Pat. No. 4,100,265, July 11, 1978). Although it is not sufficiently clear why the coefficient of thermal expansion of the calcined coke is reduced by intermediate cooling, a possible reason may be that some fine cracks are formed in the coke during the process wherein the coke, after being heated to a temperature of 600° to 1,000° C., is subjected to intermediate cooling and then to reheating, which cracks are considered to absorb expansion due to heating, resulting in the reduction of the overall coefficient of thermal expansion of the coke. The true density of the calcined coke is increased presumably because rapid evaporation of volatile matter and formation of a porous structure which occurs as a result thereof are suppressed by the intermediate cooling in the above specified temperature range.

Two-stage coke calcination with intermediate cooling is carried out by means of a coke calcining apparatus comprising, for example, two or more rotary kilns in series and a cooling device installed between them. An example of a coke calcining apparatus of this character is disclosed in Japanese Patent Laid-Open Publication 118995/1980 (Specification of U.S. Pat. No. 4,265,710) for my previous invention, in which an apparatus comprising a combination of three rotary kilns including a drying preheater and a cooler disposed between the rotary kilns of the last two stages is used.

However, the use of an apparatus of this character in which a plurality of rotary kilns are used, and coke at a high temperature is extracted at an intermediate point is accompanied by problems such as the following.

(a) Since there are several kilns, the apparatus becomes economically disadvantageous for reasons such as increased installation cost and the large space required.

(b) The number of control points becomes great, and controls such as combustion control becomes complicated.

(c) Processing and conveying of the high-temperature coke which has been extracted at an intermediate point is difficult and, moreover, entails danger.

(d) With the increase in the physical bulk of the entire apparatus, the thermal efficiency decreases.

SUMMARY OF THE INVENTION

It is an object of this invention to provide a compact coke calcining apparatus in which, by installing an intermediate cooler directly in an intermediate part of a single kiln, the above described problems accompanying a coke calcining apparatus comprising a plurality of kilns wherein intermediate extraction of coke is carried out are solved.

More specifically, according to this invention, briefly summarized, there is provided, in a coke calcining apparatus comprising a rotary kiln structure of the shape of a hollow cylinder the axis of which is declined relative to the horizontal, whereby coke introduced into the kiln structure at an upstream end thereof flows therethrough in the declination direction to the opposite downstream end thereof, an intermediate cooler extending along the outer wall surface of the kiln structure at an intermediate part thereof as considered in the longitudinal direction thereof and having inlet and outlet parts respectively communicating with upstream and downstream interiors of the kiln structure and guide means for causing the entire quantity of coke which has flowed through the upstream interior to flow through the intermediate cooler, the coke being subjected to a first-stage heating in the upstream interior and then, after being cooled in the intermediate cooler, being subjected to a second-stage heating.

Incidentally, it has been known, in a broad sense, to attach a cooler directly to a rotary kiln (Japanese Pat. Publn. No. 26397/1980). In this case, however, the cooler is attached to the withdrawal end of the kiln, and there is no suggestion of a structure wherein the calcined and cooled coke is again recycled to the kiln.

This invention will be explained in more detail hereinafter.

DETAILED DESCRIPTION OF THE INVENTION

Figure 1:
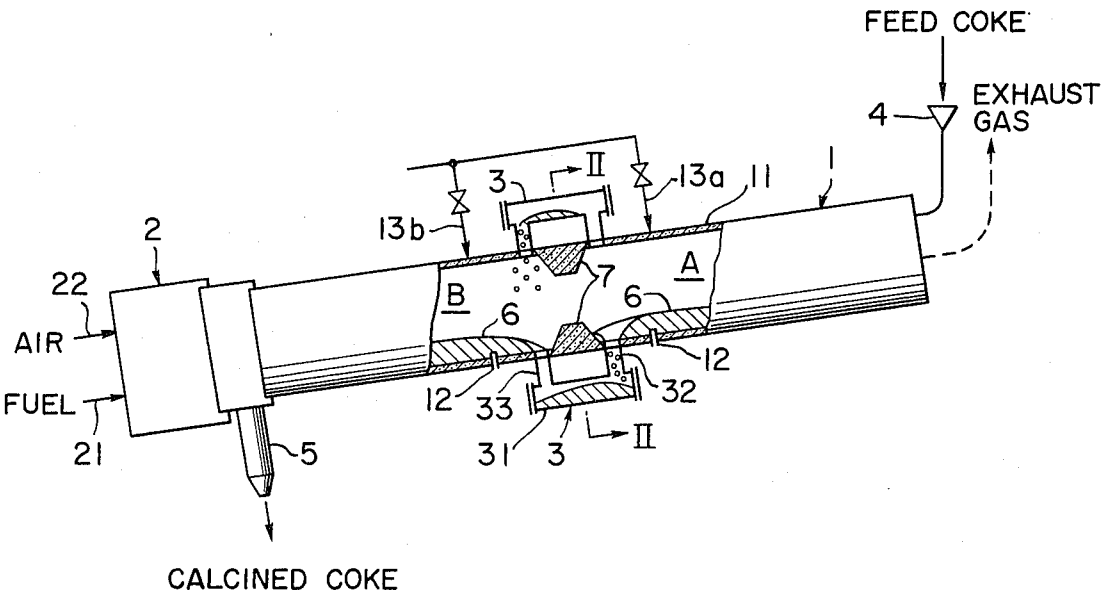
FIG. 1 is a side elevation, with a part cut away and parts shown in vertical section, showing an example of a coke calcining apparatus according to this invention in operational state.

In the embodiment of the invention shown in FIG. 1, the coke calcining apparatus comprises essentially a rotary kiln structure 1, a heating furnace 2 installed at the downstream end of the kiln structure 1, and an intermediate cooler 3 installed at an intermediate part of the kiln structure.

The kiln structure 1 is a hollow cylinder having an inner lining made of a refractory material 11, and its entire structure is constructed and adapted to be driven by a driving device (not shown) about its longitudinal axis, which is declined slightly in the coke flow direction. Temperature sensors 12, 12 are provided in the wall of the kiln structure 1 at least at points respectively upstream and downstream of the intermediate cooler 3. Furthermore, the kiln structure 1 is provided at its upstream end with a feed hopper 4 for introducing starting-material (or green) coke thereinto and at its downstream end with a hopper or chute 5 extending downward for discharging calcined coke.

As mentioned above, the heating furnace 2 is connected to the downstream end of the kiln structure 1 and is supplied through piping 21 and 22 with fuel and air, which are caused to undergo combustion. The resulting combustion gas is sent into the kiln structure 1 and becomes a source of heat for calcining the coke 6 flowing through the kiln structure. In addition, the kiln structure is provided at suitable positions in its side wall with air inlet pipes 13*a*, 13*b*, etc., for supplying air for combustion of combustible volatile substances generated from the coke 6.

Since the above described kiln structure 1, heating furnace 2, the hoppers 4 and 5, and related parts are similar to those of conventional rotary kilns for coke calcination, detailed description of their construction will be omitted.

Figure 2:
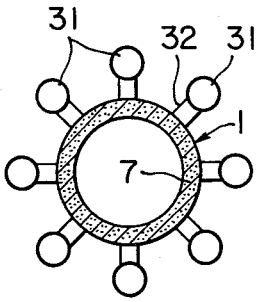
FIG. 2 is a cross section taken along the plane indicated by line II—II in FIG. 1 as viewed in the arrow direction and showing the stellate constructional arrangement of the intermediate cooler.

The intermediate cooler 3 provided according to this invention comprises a plurality of cylindrical tubes 31 disposed substantially parallelly to the kiln axis in a circle coaxial with and spaced apart from the kiln structure 1, the tubes 31 being spaced at equal angular intervals around the circle, at an intermediate part of the kiln in its axial direction and inlet and outlet pipes 32 and 33 communicatively connecting the upstream and downstream ends, respectively, of each tube 31 to the upstream interior space A and the downstream interior space B, respectively, of the kiln structure 1. At least two of the tubes 31 are provided, but four or more can be provided in stellate arrangement with their inlet and outlet pipes 32 and 33 as shown in the cross section in FIG. 2.

The inner wall surface of the kiln structure 1 is provided therearound and at its part between the inlet and outlet pipes 32 and 33 of the cooler 3 with an annular inwardly-projecting weir 7 of a longitudinal section in the shape of an isosceles trapezoid. This weir 7 constitutes an obstruction to the flow of the coke 6 along the inner wall surface of the kiln from the upstream interior space A to the downstream interior space B and functions to direct the coke to flow into and through the intermediate cooler 3 in traveling from the space A to the space B.

An example of the process of coke calcination with the use of the apparatus described above and illustrated in FIGS. 1 and 2 will now be described. For the starting-material coke to be fed through the hopper 4, a green coke obtained, for example, by the delayed coking process and adjusted in particle size to consist of about 25 percent of particles less than 3-mesh size and about 75 percent of those above 3-mesh size and have a maximum diameter of 70 mm or less is used. Typical characteristics of green coke are a moisture content of 7 to 10 percent (by weight as in the case of all percentages hereinafter set forth), a volatile matter content of 6 to 10 percent (according to Japanese Industrial Standards, JIS M8812), and an apparent density of 0.80 to 0.95 gram/cm$^3$ (g/cc).

The starting-material coke fed into the upstream end of the interior of the kiln 1 is subjected, during its travel from the upstream end to the downstream end of the upstream interior space A (that is, until it reaches the inlet part of the intermediate cooler 3), to a first-stage heating to a temperature of 600° to 1,000° C. by the combustion gas of the heating furnace 2, described hereinafter, as well as, according to necessity, by the combustion gas obtained by combustion of combustible volatile matter generated from the coke itself by air introduced into the kiln through the pipes 13*a*, 13*b*, etc. During this process moisture and combustible volatile matter are distilled off. On the other hand, the heat of the exhaust gas issuing out of the kiln structure 1 may be recovered in a conventional manner such as by preheating of air for combustion.

The angle of declination of the kiln structure 1 is from 1.2 to 3.0 degrees, and the inner diameter, length, and rotational speed thereof are so selected that a retention time of 30 to 120 minutes can be obtained. As one example, for a green coke feed rate of 10 tons/hr, a kiln structure of an inner diameter of 2.3 meters (m), a length of 40 m, and a rotational speed of 0.2 to 1.0 rpm is used.

The coke which has undergone the first-stage heating and has reached the downstream end of the upstream interior space A of the kiln 1 is obstructed in its flow by the aforedescribed weir 7, which has a height of 0.3 to 0.6 m for a kiln structure 1 of an inner diameter of 2.3 m. Then, as the kiln 1 rotates, this coke passes through the inlet pipes 32 to flow down into the intermediate cooler 3.

Each of the tubes 31 of the intermediate cooler 3 has an inner diameter of 600 mm and a length of 5 m, and each of the inlet pipes 32 and the outlet pipes 33 has an inner diameter of 600 mm. For a starting-material coke feed rate of 10 tons/hr, from 2 to 8 combinations of the tube 31 and inlet and outlet pipes 32 and 33 are used.

Figure 3:
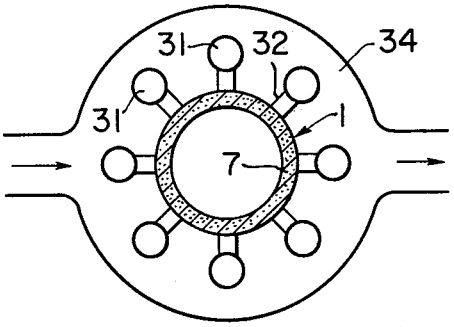
FIG. 3 is a cross section showing an example wherein a jacket is provided to encompass the intermediate cooler.

The coke which has entered the tubes 31 of the intermediate cooler 3 rotating unitarily together with the kiln structure 1 progressively travels to the outlet pipe 33 side while rolling around the interior of the tubes 31. During this travel, this coke is cooled to a temperature below 200° C., preferably 60° to 100° C. Preferably, in order to promote the cooling, the intermediate cooler 3 is provided with cooling fins (not shown), and the entire cooler 3 is surrounded by a cowling or jacket 34 as shown in FIG. 3, air being forced to flow through this jacket 34 thereby to obtain forced-draft cooling. Depending on the necessity, the promotion of cooling may be accomplished by water jackets (not shown) accommodating all or some or the entirety or parts of the individual tubes 31 of the cooler 3.

The coke thus cooled in each tube 31 passes through the outlet pipe 33 thereof when that tube 31 reaches the elevated position above the kiln structure 1. The coke thus flows into the downstream part B of the kiln.

In the downstream part B of the kiln, the coke 6 is again heated by the combustion gases from the heating furnace 2, etc., and is calcinated at a temperature of 1,200° to 1,400° C. Thereafter the calcinated coke passes through the hopper chute 5, thereby being discharged out of the kiln 1, and is cooled. The retention time within the downstream part B is from 30 to 90 minutes, of which approximately 10 to 30 minutes is the time in which coke is subjected to the calcination temperature. Ordinarily, the discharged coke is introduced into a rotary-kiln type cooler (not shown) provided in its interior with suitably arranged spray nozzles for spraying cooling water directly on the coke to cool the same. If desired, however, the coke may be gas cooled.

Examples of the characteristics of calcined coke obtained in this manner and those of calcined coke obtained without intermediate cooling are set forth below.

| | Intermediate cooling: | |
|---|---|---|
| | With | Without |
| Apparent density (g/cm$^3$) | 1.42 | 1.42 |
| True density (g/cm$^3$) | 2.169 | 2.110 |
| Coefficient of thermal expansion* (roasted at 1,000° C.) ($\times 10^{-6}$/°C.) | 1.1 | 1.2 |
| Coefficient of thermal expansion (graphitized at 2,600° C.) ($\times 10^{-6}$/°C.) | 0.7 | 0.8 |

*The coefficient of thermal expansion (coefficient of linear expansion) is measured in the following manner.

The calcined coke in each case is ground to obtain a mixture of 92 percent of particles larger than 200 mesh and 8 percent of those smaller than 200 mesh. With 100 parts of this mixture, 25 parts of a coal tar binder pitch (softening point, 90.3° C.; a benzene insoluble content, 19.8%; a quinoline insoluble content, 4.4%; a volatile matter content, 62.7%; a fixed carbon content, 53.2%) is mixed. The mixture is heated and then molded into pieces some of which are roasted at 1,000° C. and others are graphitized at 2,600° C. From these pieces, test pieces (round rods of 5-mm diameter and approximately 50-mm length) are made and used to measure their coefficients of thermal expansion in a temperature range of 30° to 100° C.

While, in the disclosure set forth above, a basic example of the coke calcining apparatus of this invention and its mode of operation have been described, various modifications within the purview of this invention can be made in the construction of intermediate cooler and parts therearound.

Figure 4:
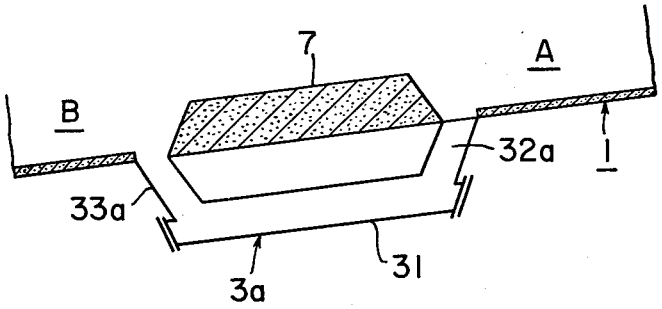
FIG. 4 is a relatively enlarged, fragmentary side elevation, in vertical section, showing a part of the intermediate cooling region with the inlet and outlet pipes of the intermediate cooler in inclined state.
Figure 5:
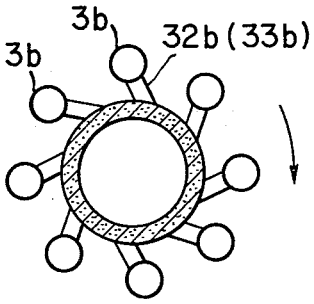
FIG. 5 is a cross section corresponding to FIG. 2 and showing another example of construction of the inlet and outlet pipes of the intermediate cooler in which these pipes are inclined relative to radial directions.

For example, as shown in FIG. 4, the inlet pipe **32*a* and the outlet pipe 33*a* of the cooler 3*a* shown are inclined by an angle of, for example, 1 to 60 degrees, from the vertical direction, in the longitudinal direction of the outer wall of the kiln structure 1. This construction affords smooth entry and exit of the coke into and out of the cooler 3*a* and may be said to be preferable. Furthermore, as shown in FIG. 5, the inlet pipes 32*b* and the outlet pipes 33*b* can also be tilted by an angle of, for example, 1 to 60 degrees from respective radial directions at their connections to the outer cylindrical surface of the kiln structure 1, the tilting being in the direction opposite to the rotational direction. By this construction, also, smooth flow of the coke into and out of the cooler 3*b*** is afforded.

Figure 6:
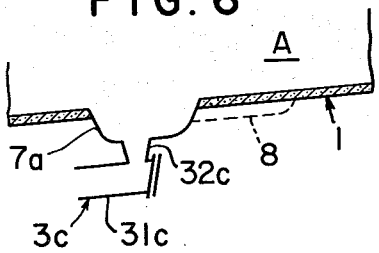
FIG. 6 is a relatively enlarged, fragmentary side elevation, in vertical section, showing another example of guide means for moving coke to the intermediate cooler.

In still another modification, the means at the middle part of the kiln structure 1 for arresting the flow of the coke in the axial direction and causing it to flow into the cooler 3 can take a form as follows. In place of the weir 7 as illustrated in FIGS. 1 and 4, an annular, gutter-like trough **7*a* is formed around the wall of the kiln structure 1 at its part where the coke is to enter the cooler 3*c* from the upstream part A through the inlet pipes 32*c* as shown in FIG. 6, the trough 7*a* being sunken outward from the inner wall surface of the kiln structure 1. Preferably, guide grooves 8 are provided to facilitate the flow of the coke into the trough 7*a* and the inlet pipes 32*c***.

Furthermore, a lifting conveyor plate of trough shape similar to that in the cooler disclosed in Japanese Patent Publication 26397/1980 may be provided to extend in helical shape along and around the inner wall surface of each tube 31 of the cooler 3.

As described above, the coke calcining apparatus of this invention is provided at the middle part of its rotary kiln structure with an intermediate cooler which communicatively connects the upstream part and the downstream part of the kiln interior and means for causing the coke flowing along the kiln interior to flow into the intermediate cooler. As a result, a two-stage calcination process involving an intermediate cooling, which is suitable for producing high-grade coke, can be practiced with a single kiln, and a coke calcining apparatus which as a whole is compact and can be easily operated with good heat efficiency is provided.

What is claimed is:

1. A coke calcining apparatus comprising: a rotary kiln structure of the shape of a hollow cylinder the axis of which is declined relative to the horizontal, whereby coke introduced into the kiln structure at an upstream end thereof flows therethrough in the declination direction to the opposite downstream end thereof; an intermediate cooler extending along the outer wall surface of the kiln structure at an intermediate part thereof as considered in the longitudinal direction thereof and having inlet and outlet parts respectively communicating with upstream and downstream interiors of the kiln structure; and guide means for causing the entire quantity of coke which has flowed through the upstream interior to flow through the intermediate cooler, said coke being subjected to a first-stage heating in the upstream interior and then, after being cooled in the intermediate cooler, being subjected to a second-stage heating.

2. A coke calcining apparatus according to claim 1 in which the intermediate cooler comprises a plurality of tubular structures each having inlet and outlet parts, which are respectively connected to the upstream and downstream interiors, and having an axis substantially parallel to the axis of the kiln structure, the tubular structures being arranged in stellate arrangement around the kiln structure as viewed in cross section.

3. A coke calcining apparatus according to claim 1 in which the inlet and outlet parts of the intermediate cooler comprise pipes with axes substantially perpendicular to the outer wall surface of the kiln structure.

4. A coke calcining apparatus according to claim 1 in which the inlet and outlet parts of the intermediate cooler comprise pipes with axes sloped relative to the outer wall surface of the kiln structure so as to make smooth the inflow of coke from the upstream interior of the kiln structure into the intermediate cooler and the outflow of coke from the intermediate cooler into the downstream interior.

5. A coke calcining apparatus according to claim 1 in which the guide means comprises an annular weir fixed to and around the inner wall surface of the kiln structure at a part thereof between the inlet and outlet parts of the intermediate cooler and projecting inward.

6. A coke calcining apparatus according to claim 1 in which the guide means comprises an annular trough-like depression formed in and around the inner wall surface of the kiln structure at the downstream end of the upstream interior thereof and having a bottom to which the inlet part (or parts) of the intermediate cooler is communicatively connected.

7. A coke calcining apparatus according to claim 6 in which guide grooves are provided on the upstream side of the trough-like depression of the kiln structure.

8. A coke calcining apparatus according to claim 1 in which: the upstream interior part of the kiln structure has a capacity of carrying out a first-stage calcination at 600° to 1,000° C. of coke; the intermediate cooler has a capacity of cooling the coke calcined in the first stage to a temperature of 200° C. or less; and the downstream interior part of the kiln structure has a capacity of heating the coke thus cooled and of subjecting said coke to a second-stage calcination at a temperature of 1,200° to 1,400° C. for approximately 10 to 30 minutes.

* * * * *